United States Patent [19]

Fujihara et al.

[11] Patent Number: 4,709,644

[45] Date of Patent: Dec. 1, 1987

[54] SEWING MACHINE PRESSER FOOT LIFTING APPARATUS

[75] Inventors: Masaaki Fujihara; Ikunori Fujii; Shuji Fujita, all of Chofu, Japan

[73] Assignee: Tokyo Juki Industrial Co., Ltd., Tokyo, Japan

[21] Appl. No.: 875,591

[22] Filed: Jun. 18, 1986

[30] Foreign Application Priority Data

Jun. 20, 1985 [JP] Japan ..... 60-135117
Jun. 20, 1985 [JP] Japan ..... 60-135118

[51] Int. Cl.[4] ..... D05B 29/00
[52] U.S. Cl. ..... 112/237
[58] Field of Search ..... 112/237, 239, 221

[56] References Cited

U.S. PATENT DOCUMENTS

| | | | |
|---|---|---|---|
| 2,558,010 | 6/1951 | Sporney | 112/237 |
| 2,836,137 | 5/1958 | Ayres | 112/237 |
| 3,777,685 | 12/1973 | Baruffa | 112/237 X |
| 4,436,043 | 3/1984 | Cantada | 112/221 |

*Primary Examiner*—Werner H. Schroeder
*Assistant Examiner*—Andrew M. Falik
*Attorney, Agent, or Firm*—Morgan & Finnegan

[57] ABSTRACT

An apparatus for lifting the presser foot of a sewing machine prevents the bar guide bracket from rotating outward even when the presser foot is unintentionally raised due to a thick workpiece. As an additional safety interlock, the presser bar guide bracket is prevented from dropping down when the presser foot is rotated to provide space for changing the needle or setting the thread.

5 Claims, 12 Drawing Figures

FIG. 3C
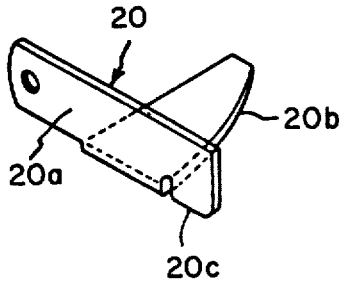
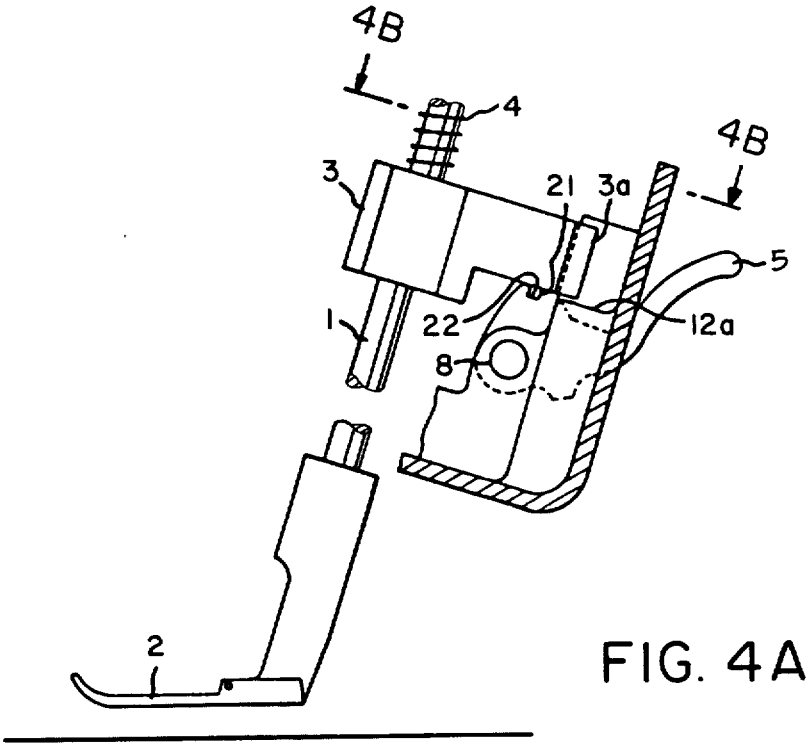
FIG. 4A

SEWING MACHINE PRESSER FOOT LIFTING APPARATUS

BACKGROUND OF THE INVENTION

When a sewing machine needle is to be changed, or a thread is to be set in the eye of the needle, the presser foot of the sewing machine is lifted, and its pressing action released, by lifting a presser foot lifting lever and the presser foot lifting lever is rotated outward around a presser bar to provide enough space for an operator to perform the aforementioned manual tasks.

Under such circumstances, the usual practice has been to design the sewing machine so as not to start even if the operator unintentionally attempts to start it. The sewing machine is designed so that the presser bar guide bracket is engaged with the needle bar preventing the sewing machine from starting. The needle bar is stopped by the presser bar guide bracket.

In conventional sewing machines, if the presser foot is pressing, by means of its presser spring, the workpiece against the machine bed for stitching, and if the workpiece is thick in whole or part, the presser foot is raised up to the same level as if lifted by the presser foot lifting lever and the presser bar guide bracket is derailed from its guide slit. Under such conditions, the presser foot tends to rotate outward around the presser bar because of machine vibration or due to the outward component of the work feeding force. As a result, the needle bar strikes against the presser bar guide and the parts are damaged.

SUMMARY OF THE INVENTION

With the foregoing in mind, it is an object of the invention to provide a new and improved sewing machine presser foot apparatus.

The apparatus, according to the invention, prevents the presser foot from rotating around the presser bar and is provided in association with the movement of the presser foot lifting lever. Thus, when the presser foot is in idle position (the presser foot lifting lever being in lifted position), the presser foot is easily rotated outward to provide enough space for changing the needle or setting the thread.

When the presser foot is active and pressing the workpiece during stitching (the presser foot lifting lever being in lowered position), even if the presser foot is raised to the same level as if lifted by the presser foot lifting lever, the presser foot is prevented from rotating around the presser bar. Thus, problems often experienced during stitching are eliminated. Additionally, when the presser foot is in idle condition and is rotated outward to provide enough space for needle change or thread setting, the presser foot is prevented from moving downward even if the operator mishandles the presser foot lifting lever.

BRIEF DESCRIPTION OF THE DRAWINGS

The accompanying drawings, referred to herein and constituting a part hereof, illustrate preferred embodiments of the invention and, together with the description, serve to explain the principles of the invention, wherein:

FIG. 3C is a perspective view of an action lever;

FIG. 4A is a partially sectional view of another alternative embodiment of the invention showing the presser foot in idle position;

DESCRIPTION OF THE PREFERRED EMBODIMENT

Figure 1A:
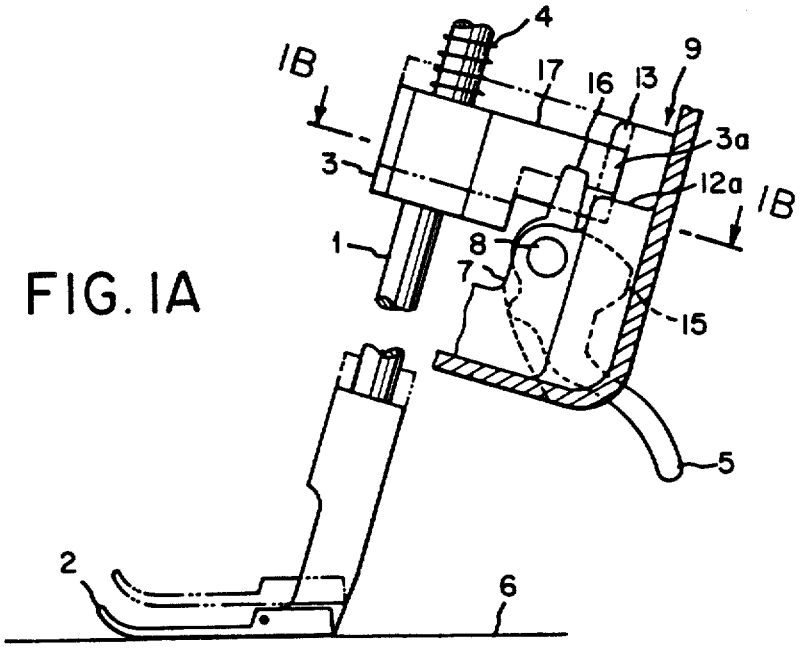
FIG. 1A is a partially sectional view of the sewing machine when the presser foot is in operating position.

Referring to the accompanying drawings, preferred embodiments of the invention will herein after be explained. A presser bar 1 is movably sustained by a machine frame so as to move up and down and also to rotate freely. A presser foot 2 is fixed to the lower end of the presser bar 1. A presser bar guide bracket 3 is fixed at the middle of the presser bar 1, and its upper surface is pressed by a presser spring 4 which is inserted between the machine frame and the presser bar guide bracket 3. Thus, the presser foot is urged to press down on a workpiece.

A presser foot lifting lever 5 is designed such that when the presser foot lifting lever 5 is in its lower position, the presser foot is pressing down on the workpiece and when the presser foot lifting lever 5 is in its upper position, the presser foot is lifted and separated from the machine bed 6''. The presser spring 4 is still pressing down on the presser foot 2. The presser foot lifting lever 5 is sustained rotatably to a shaft 8 which is fixed to the machine frame. The presser guide bracket 3 has two stoppers **3*a*, 3*b* (refer to FIG. 1B), and stoppers 3*a*, 3*b* are radially equidistant from the center of presser bar 1**.

Guiding device 9 consists of guide surfaces 11, 12 which face each other and hold the stopper **3*a* between them, so that stopper 3*a* moves up and down along its surfaces, and guide surface 13 extends upwardly from guide surface 11. A stopper 14 is located on the backside of guide surface 13. The highest point 12*a* of guide surface 12 is lower than the stopper 3*a* when the presser foot bar lifting lever 5 is lifted and the presser foot is in idle position. The presser foot lifting lever provides a cam 15 which causes the presser foot to be in operating or idle position and a projection 16 extends outward (refer to FIG. 1A). The cam 15 is positioned to contact with the bottom surface of the presser bar guide bracket 3. The projection 16 prevents the presser foot 2 from rotating outward by contacting side 17 of the presser bar guide bracket 3** when the presser foot is in operating position.

Figure 2A:
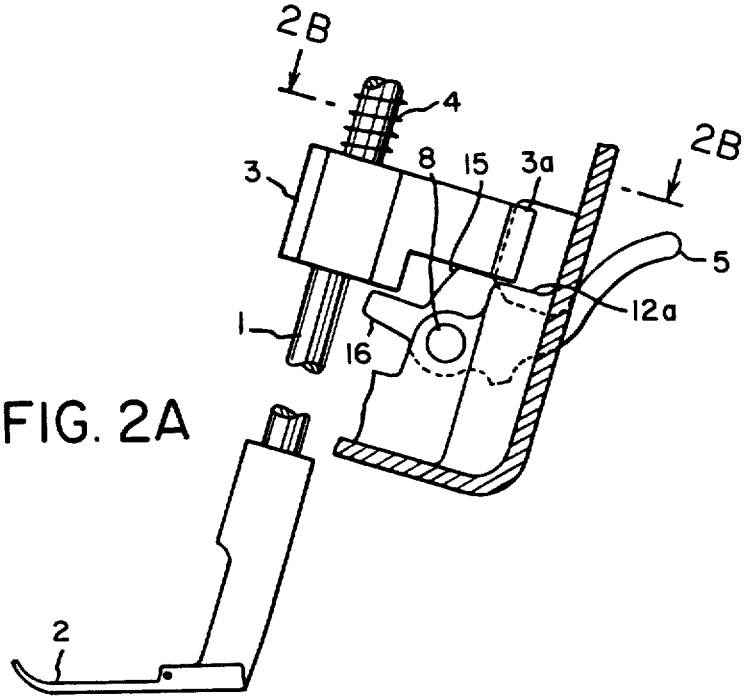
FIG. 2A is a partially sectional view of the sewing machine when the presser foot is in idle position.

Referring to FIG. 2A, when the presser foot 2 is in idle position, it is rotated outward (e.g., for change of the needle). The projection 16 is positioned adjacent to the bottom surface of the presser bar guide bracket 3 with cam 15 defining the position of the presser bar guide bracket. Thus, the position of the presser foot lifting lever 5 in idle position is defined.

The projection 16 and the side 17 constitute a first apparatus for preventing the presser bar 1 from rotating around the longitudinal axis of the presser bar. Projection 16 ahd the presser bar guide bracket 3 constitute a second apparatus for preventing the presser bar 1 from moving downward.

Figure 2B:
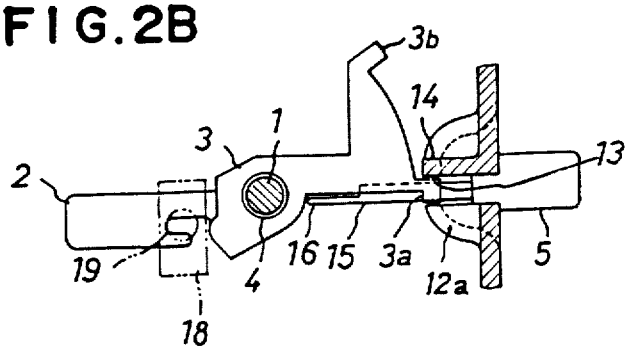
FIG. 2B is a section view along line 2B—2B in FIG. 2A.
Figure 2C:
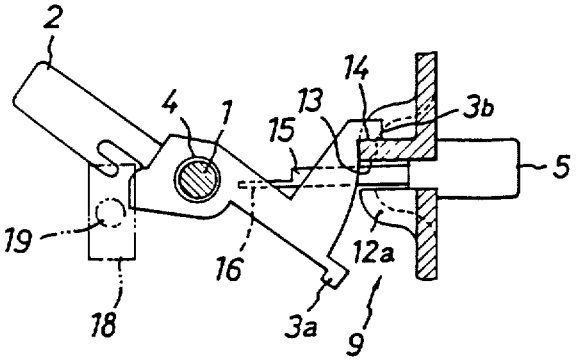
FIG. 2C shows the presser bar guide bracket of FIG. 2B when rotated outward.

Referring to FIGS. 2B and 2C, numeral 18 denotes a needle bar connection which is connected to the driving source so as to cause the needle bar to move up and down. The presser bar guide bracket 3 is lifted by the cam 15 which is connected to the presser foot lifting lever 5. With this lifting action, the presser foot 2 is lifted, with the presser bar resisting against the force of the presser spring 4, and the presser foot is released from pressing the workpiece against the bed.

Thus, the stopper 3a can be rotated clockwise (refer to FIG. 2B) with the presser bar guide bracket 3 until the stopper 3b contacts with the stopper 14 (refer to FIGS. 2B, 2C). The presser foot 2 is rotated outward to provide enough space for needle change or thread setting. In this case, if the start switch is pressed by mistake, the needle bar connection 18 is stopped by the needle bar guide bracket 3 (refer to FIG. 2C), and the sewing machine will not start operation.

Referring to FIG. 2C, the presser foot 2 is shown in idle position and when the presser foot 2 is rotated outside, if the presser foot lifting lever rotates clockwise (refer to FIG. 2A), the projection 16 contacts with the bottom surface of the presser bar guide bracket 3. Since the bottom surface of the presser bar guide bracket is positioned covering the adjacent top of projection 16, the presser foot lifting lever 5 will not rotate.

Figure 1B:
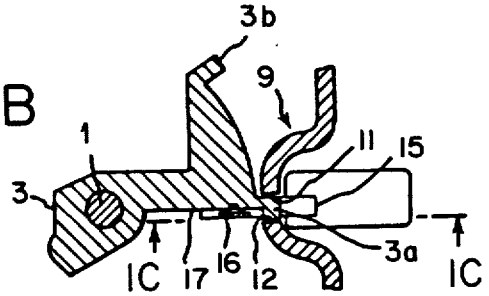
FIG. 1B is a section view along line 1B—1B in FIG. 1A.
Figure 1C:
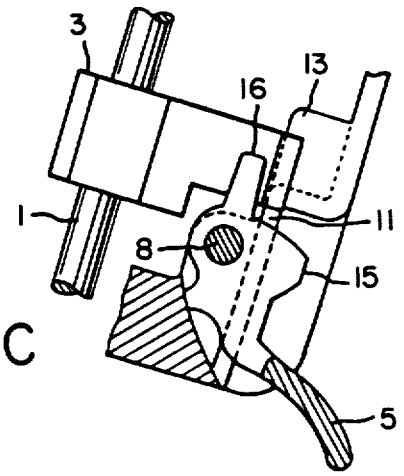
FIG. 1C is a section view along line 1C—1C in FIG. 1B.

Referring to FIG. 1A showing the presser foot 2 in operating position, as the presser foot lifting lever 5 is rotated clockwise downward, the presser bar guide bracket 3 is lowered by the force of presser spring 4 in accordance with the curvature of cam 15. Thus, the presser foot 2 presses against the machine bed 6. In this case, the stopper 3a is positioned between guide surface 11 and guide surface 12 and the presser foot 2 is positioned non-rotatably around the presser bar while stitching is conducted.

While stitching a very thick workpiece, the presser foot 2 is raised and the bottom surface of the stopper 3a is lifted higher than the top surface 12a of the guide surface (refer to FIG. 1A). The presser foot 2 does not rotate since the rotation of the presser bar guide bracket is stopped by projection 16 and the guide surface 13, and accordingly the presser foot 2 does not rotate this far because the presser foot lifting lever 5 is not in idle position. (The presser foot lifting lever 5 as yet being unlifted.)

Figure 3A:
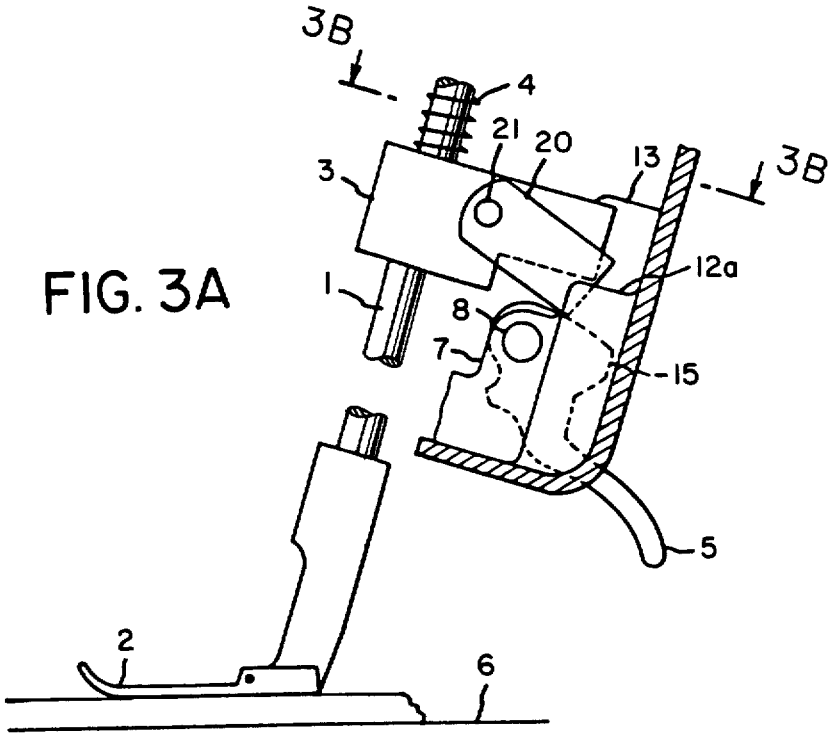
FIG. 3A is a partially sectional view of an alternative embodiment of the invention showing the presser foot in operating position.
Figure 3B:
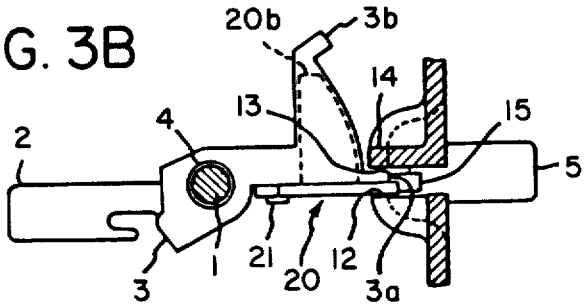
FIG. 3B is a section view along line 3B—3B of FIG. 3A.

Referring to FIGS. 3A, 3B, and 3C, another embodiment of this invention will be explained. The same numerals as in the previous preferred embodiment are used where the parts are functionally similar. Referring to FIG. 3C, an action lever 20 consists of a vertical plate 20a and a horizontal plate 20b. One end of the vertical plate 20a is rotatably sustained to the presser bar guide bracket 3 by a horizontal shaft 21 which is pivoted to the presser bar guide bracket 3.

The end of the vertical plate 20a is positioned on the cam 15 and the stopper 3a is positioned above the cam 15. When the presser foot lifting lever 5 is lifted to set idle position of the presser foot, the action lever 20 will be raised by the cam 15, with the presser bar guide bracket 3, and the bottom surface 20c of the vertical plate 20a will be moved higher than the top 12a of the guide surface 12. When the presser foot is in operating position, the bottom surface 20c is positioned with the stopper 3a between guide surface 11 and guide surface 12. When the presser foot is lifted, the presser foot 2 can be rotated outward (refer to FIG. 3B), and when the presser foot 2 is in operating position, the presser foot is lowered. Even if the presser foot 2 is raised up to idle position by a thick workpiece as shown in FIG. 3A, the action lever 20 rotates clockwise around the shaft 21 by itself by means of gravity and a portion of the vertical plate 20a enters between guide surface 11 and guide surface 12. Thus, the rotation of the presser foot 2 is stopped.

In this embodiment, the action lever 20 and the guide surface 12 constitute a preventive apparatus for presser foot 2 from rotating around the presser bar 1 when workpiece is very thick and raises the presser foot 2 to the same position as if lifted by the presser foot lifting lever 5.

Figure 4B:
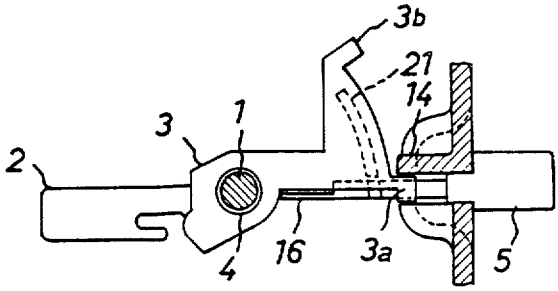
FIG. 4B is a section view along line 4B—4B in FIG. 4A.
Figure 4C:
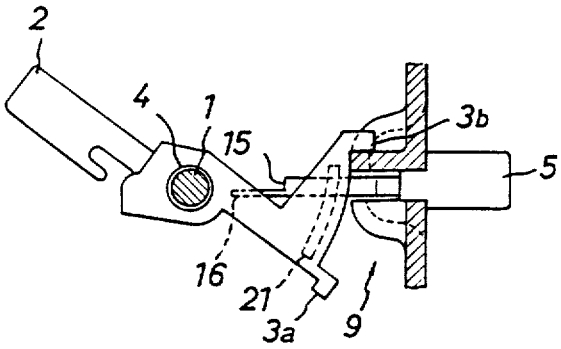
FIG. 4C shows the presser bar guide of FIG. 4B when rotated.

Referring to FIGS. 4A, 4B, and 4C, another embodiment of the invention is explained. The same numerals as in the previous preferred embodiments are again used where the parts are functionally similar.

Referring to FIG. 4A, a channel slit 22 is provided at the top of the portion of cam 15. Referring to FIG. 4C and FIG. 4B, a projection 21 is provided at the bottom surface of the presser bar guide bracket 3. This circumferentially shaped projection 21 engages with the channel slit 22 and when the presser foot 2 rotates around the presser bar 1, the projection 21 passes through the channel slit 22.

Referring to FIG. 4B, when the presser foot 2 is positioned in normal direction, the projection 21 is not in contact with the channel slit 22 and the presser foot lifting lever 5 can be rotated as needed. Referring to FIG. 4C, when the presser foot 2 is rotated outward, the projection 21 enters in the channel slit 22 and the presser foot lifting lever 5 does not rotate.

In this embodiment, the channel slit 22 and the projection 21 constitute a preventive apparatus for preventing the presser foot 2 from moving downward. In this embodiment, the presser foot lifting lever 5 does not provide projection 16 of the previous embodiment, but it will be appreciated that this projection 16 can be also be adapted to this embodiment.

It is to be understood that the above-described embodiments of the invention are illustrative only and that modifications thereof may be made without departing from the scope and spirit of the invention.

What is claimed:

1. In a presser foot lifting mechanism, wherein a presser bar with a presser foot at its lower and receives a continuous downwardly directed force and is in an operating position when pressing a workpiece against a machine bed and is in an idle position when the presser foot is lifted and rotated outwardly around the longitudinal axis of said presser bar, a sewing machine presser foot lifting foot lifting apparatus, comprising:

a first means associated with a presser foot lifting lever for preventing the presser foot from rotating outward when the presser foot is either in operating position or regardless of the level to which the presser foot is raised a second means associated with the rotation of the presser foot for preventing unintentional lowering of the presser foot when the presser foot is in said idle position.

2. A sewing machine presser foot lifting apparatus according to claim 1, wherein said first means comprises:

a presser foot lifting lower providing a projection thereon; and a presser bar guide bracket; wherein the projection on said presser foot lifting lever contacts the side of said presser bar guide bracket when the presser foot is in said operating position thereby preventing the presser foot from rotating.

3. A seewing machine presser foot lifting apparatus according to claim 1, wherein said second means comprises:

a presser foot lifting lever providing a projection thereon; and a presser bar guide bracket; wherein said presser bar guide bracket covers the top of the projection on said presser foot lifting lever thereby preventing said presser foot lifting lever from rotating.

4. A sewing machine presser foot lifting apparatus according to claim 1, wherein said first means comprises:

an action lever providing a vertical plate thereon;

a first guide means; and a second guide means; wherein the vertical plate of said action lever enters between said first and second guide means when the presser foot is in idle position thereby preventing the presser foot from rotating.

5. A sewing machine presser foot lifting apparatus according to claim 1, wherein said first means comprises:

a cam providing a channel slit therein; and a presser bar guide bracket providing a projection thereon; wherein the projection of said presser bar guide bracket enters the channel slit of said cam when the presser foot is in operating position thereby preventing the presser foot from rotating.

* * * * *

UNITED STATES PATENT AND TRADEMARK OFFICE

CERTIFICATE OF CORRECTION

PATENT NO. : 4,709,644

DATED : December 1, 1987

INVENTOR(S) : Fujihara et al.

It is certified that error appears in the above-identified patent and that said Letters Patent is hereby corrected as shown below:

Claim 1, line 2, "and" should be --end--.

Claim 1, line 8, "foot lifting" (second occurrence) should be deleted.

Claim 2, line 4, "lower" should be --lever--.

Claim 3, line 1, "seewing" should be --sewing--.

Signed and Sealed this

Twenty-first Day of June, 198

*Attest:*

*Attesting Officer*

DONALD J. QUIGG

*Commissioner of Patents and Trademarks*